United States Patent [19]

Fletcher et al.

[11] 3,949,404

[45] Apr. 6, 1976

[54] HIGHLY EFFICIENT ANTENNA SYSTEM USING A CORRUGATED HORN AND SCANNING HYPERBOLIC REFLECTOR

[76] Inventors: James C. Fletcher, Administrator of the National Aeronautics and Space Administration, with respect to an invention of Kenneth A. Green, Andover, Mass.

[22] Filed: Dec. 19, 1974

[21] Appl. No.: 534,265

[52] U.S. Cl. ..... 343/761; 343/781; 343/786

[51] Int. Cl.[2] ..... H01Q 13/02; H01Q 15/16

[58] Field of Search ..... 343/781, 840, 786

[56] References Cited

UNITED STATES PATENTS 3,216,018 11/1965 Kay ..... 343/781

3,792,480 2/1974 Graham ..... 343/837

*Primary Examiner*—Eli Lieberman

*Attorney, Agent, or Firm*—Monte F. Mott; Paul F. McCaul; John R. Manning

[57] ABSTRACT

In a horn-reflector antenna system for producing a spherical aperture phase front, a corrugated conical horn illuminates a section of a hyperbolic reflector to produce a spherical aperture phase front which produces a far-field beam with low sidelobes and high beam efficiency. The system is insensitive to frequency and polarization changes, and is also insensitive to orientation about the axis of the conical horn for beam scanning.

10 Claims, 6 Drawing Figures

HIGHLY EFFICIENT ANTENNA SYSTEM USING A CORRUGATED HORN AND SCANNING HYPERBOLIC REFLECTOR

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 U.S.C. 2457).

BACKGROUND OF THE INVENTION

This invention relates to antenna systems, and more particularly to a system for producing a beam with a spherical aperture phase front and a far-field beam with low sidelobes and high efficiency.

Beam efficiency has become an important criteria for microwave antenna systems, particularly for those requiring low noise reception such as radiometry and space telemetry. The objective is to deliver a maximum of radiated energy, considered on a transmit basis, in a predescribed cone. By definition, the cone angle is only 2.5 times the half power beam width.

An obvious design choice is a horn antenna feeding a reflector offset 45°. The reflector can be rotated about the horn axis for beam scanning. Large horn-fed parabolic reflectors are known to have beam efficiencies of approximately 90%. Large Cassegrain systems have beam efficiencies in the order of 85%. High efficiencies are not achieved with these reflector designs because of feed horn sidelobes, spillover past the reflector or reflectors, aperture blockage, diffraction from reflector edges and from aperture blockage, and far field sidelobes of the diffraction pattern of the linear phase aperture field. To achieve an efficiency of 95%, a design must be developed that minimizes or eliminates these effects.

A high beam efficiency of approximately 93% has been achieved utilizing a lens corrected corrugated horn as described by A. F. Kay in U.S. Pat. No. 3,274,603. Briefly, the corrugations suppress illumination in the E plane of the edges of the horn sufficiently for the horn aperture to be illuminated in the E plane with relatively low illumination of the edges similar to that of the H plane. The radiation patterns in both planes are thus made to be similar. This significantly reduced sidelobes and spillover past the parabolic reflector, but the antenna system is still efficiency limited by far-field diffraction sidelobes. The first sidelobe is typically about −20dB and subtracts several percent from beam efficiency.

SUMMARY OF THE INVENTION

In accordance with the present invention, an antenna system for producing a spherical aperture phase front is comprised of a reflector having a reflecting surface that is a section of a hyperboloid and means for illuminating the reflector with a spherical expanding wave having its phase center at the focus of the hyperbolic reflecting surface. The reflector is supported by means that may be rotated about the axis of the illuminating beam for beam scanning through 360°.

The novel features that are considered characteristic of this invention are set forth with particularity in the appended claims. The invention will best be understood from the following description when read in connection with the accompanying drawings.

DESCRIPTION OF THE PREFERRED EMBODIMENTS

Figure 1:
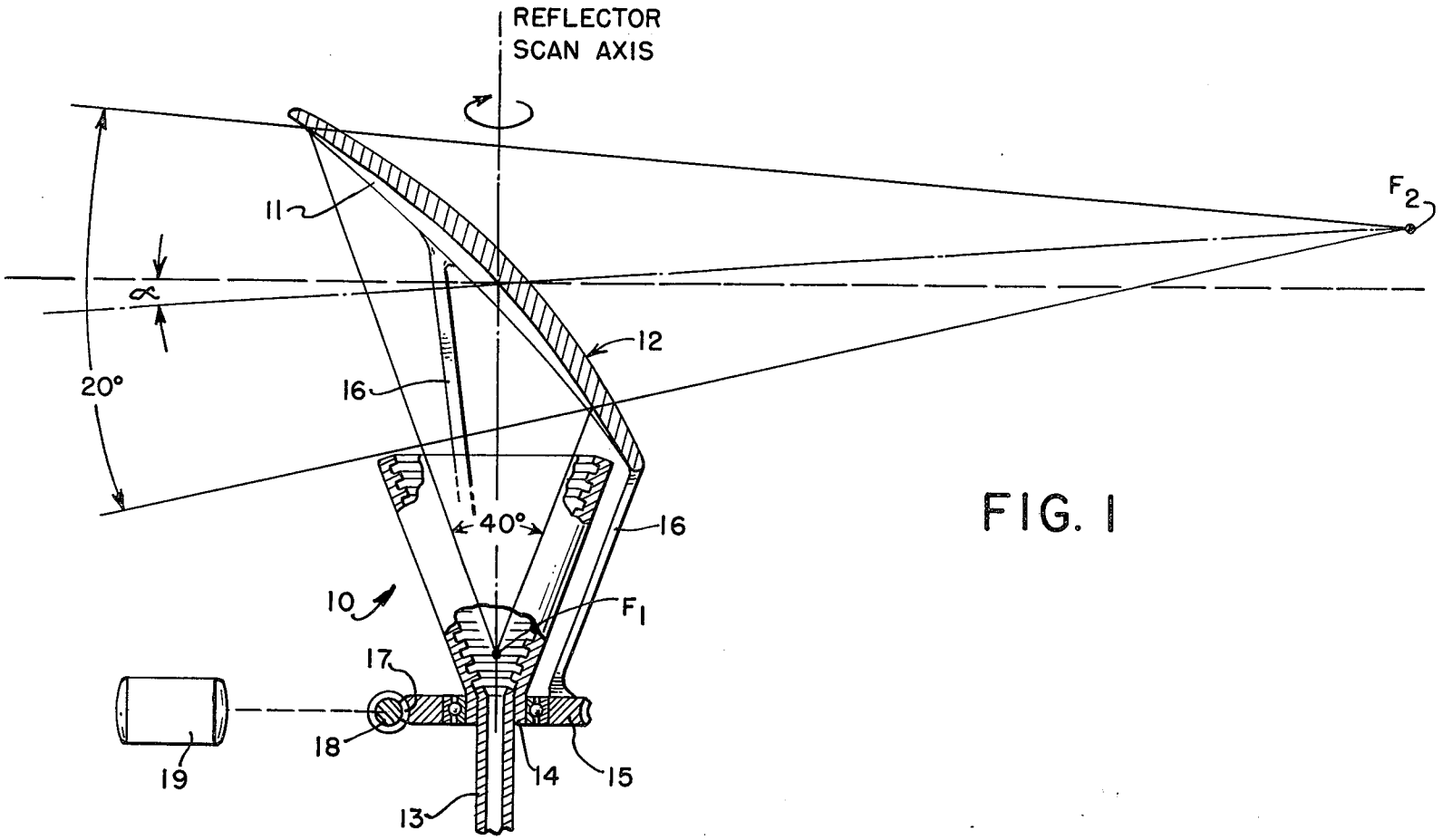
FIG. 1 is a fragmentary sectional view schematically illustrating a scanning antenna system utilizing the principles of the invention.

With reference now to FIG. 1, an antenna system is provided by a corrugated conical horn 10 used to illuminate the concave side 11 of a hyperbolic reflector 12 to produce a narrow beam with low sidelobes and high beam efficiency of about 96%. A circular waveguide 13 feeds the horn 10 with microwave electromagnetic energy of arbitrary polarization.

The corrugated conical horn produces a circularly symmetric, spherical expanding wave of an included angle twice the angle of the desired narrow beam and without sidelobes. The expanding wave illuminates the hyperboloid and is reflected as another spherical expanding wave of an included angle equal to the desired narrow beam. The beam energy is in a cone defined by an angle which is 2.5 times the half power beam width. Since the half power width is 7.5° to 8°, the cone half angle is nearly 10°.

The concave side 11 of the reflector 12 is a section of a hyperboloid having its foci $F_1$ and $F_2$ at the phase center of the spherical expanding wave and the reflected image source. The section of the hyperboloid selected is that portion illuminated by the spherical expanding wave emanating from the horn 10 once the position of the focus $F_2$ is fixed. In the illustrated embodiment, a fixed depression angle $\alpha$ is provided for the narrow reflected beam.

If a sufficiently large section of the hyperboloid is provided as the reflector, it would be possible to scan in elevation by providing a suitable mechanism for so shifting the axis of the conical horn relative to the reflector as to pivot the axis of the foci about the focus $F_1$. However, in the illustrated embodiment, it is contemplated that the beam be scanned only about the cone axis of the horn. To accomplish that scanning motion, the reflector may be supported from the base 14 of the horn using a collar 15 journaled on the base and struts 16 to the sides and rear of the reflector, leaving the front clear of any structure. To rotate the reflector and its support structure, the collar may be formed with gear teeth 17 that mesh with a threaded shaft 18 to form a worm gear. It is then a simple matter to drive the shaft with a bidirectional motor 19 to scan in either direction about the axis of the horn, through any number of revolutions.

This combination of a corrugated conical horn and a single hyperbolic reflector produces a beam with low sidelobes and high beam efficiency. The system is insensitive to frequency and polarization changes. The spherical aperture field is the main feature contributing to high beam efficiency, low sidelobes, and beam insensitivity to frequency. All electromagnetic waves in space will normally transform to a spherical expanding wave, and in so doing, sidelobes are created, but when a corrugated conical horn produces a spherical expanding wave in its aperture, the wave will expand in a cone defined by the antenna system geometry without transformation; hence without sidelobes, and with little variation in width with variation in frequency. This phenomenon is the property of the corrugated conical horn alone. The reflector functions to produce a large, narrow angle image of such a horn. A long, narrow horn would produce the same narrow beam without sidelobes, but would be of impractical length, and could not be easily scanned. The hyperbolic reflector not only provides for folding the antenna system, but also provides for lengthening the virtual conical horn with the same actual aperture, thus concentrating all of the illuminating energy from the horn in a narrower cone (beam).

The disadvantage of using a hyperboloid is that the cross section of the beam formed is broader than from a parabolic reflector of the same aperture size. It has been well known for many years that a linear phase in aperture antennas gives maximum theoretical directivity. For that reason parabolic reflectors have been used extensively to maximize gain and minimize size, but this should not imply that aperture phase must be linear. The significant fact to be noted is that parabolic reflectors do not yield maximum beam efficiency, so important in sensitive systems. Space communications designers in the past realized that reducing antenna noise contributions could be more important than increasing antenna gain or directivity. High beam efficiency is somewhat analogous to low antenna noise. Consequently the present invention is of significant value in communication and radar systems requiring extremely low noise, as well as in low noise microwave sensors (radiometers).

Three antenna systems embodying the present invention have been operated at approximately 22, 31 and 54 GHz. Each was an electrical scale model of the others and exhibited essentially the same performance over wide bandwidths. In each system, the corrugated conical horn had a half angle of about 20°, contained 23 corrugations (3 per wavelength), and produced a half power beamwidth of 15°. Reflector size and shape were chosen for about −17 dB edge illumination and a 2/1 reduction in divergence of edge rays. Spillover past the reflector was 2% to 3% of the energy radiated by the feed. In each case the concave hyperbolic reflector was chosen to produce beams of 20° as illustrated in FIG. 1.

It has been generally accepted that corrugated horns for beams of less than 12° half power width are impractical, but the concave hyperbolic reflector can produce beams of 5° or less half power width. The limitation in width for any system is that the spherical phase front produced in the reflector's aperture must deviate at least one half wavelength from the linear phase front that would have been produced by a paraboloid of the same size. Otherwise the slidelobes characteristic of a linear aperture phase will be present which implies reduced beam efficiency.

Figure 2:
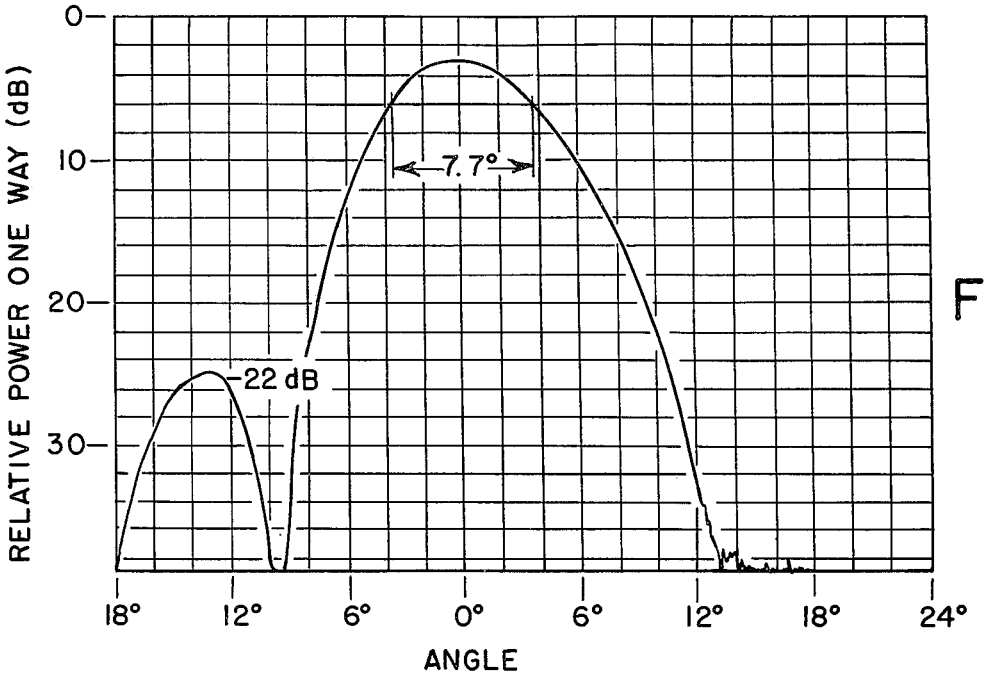
FIGS. 2 and 3 are expanded beam patterns in longitudinal and transverse planes of the antenna system of FIG. 1.
Figure 3:
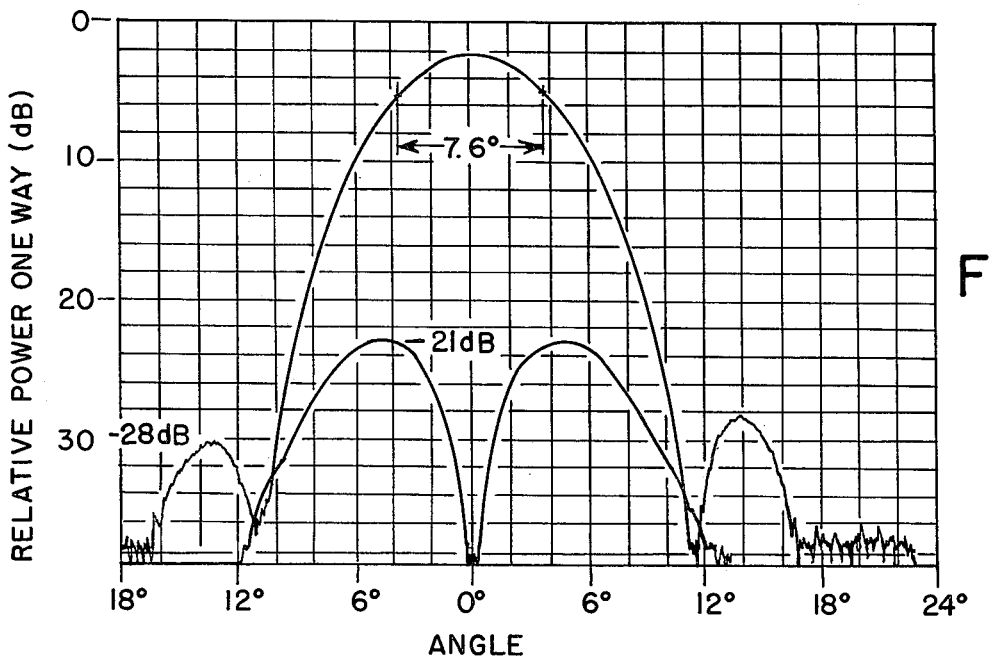

FIGS. 2 and 3 are expanded patterns of mainlobes and first sidelobes measured at 31.65 GHz over a 35 dB dynamic range in the principal (longitudinal and transverse) planes. The longitudinal plane (FIG. 2) is the plane containing the axis of the horn, and the transverse plane (FIG. 3) is the plane normal to it, i.e., normal to the plane of the paper. The cross polarization is typical of offset-fed reflectors. The asymmetrical sidelobe in the longitudinal plane was caused by the reflector's close proximity to the horn at its lower edge, and can be avoided with a larger reflector at a greater distance from the horn.

Figure 4A:
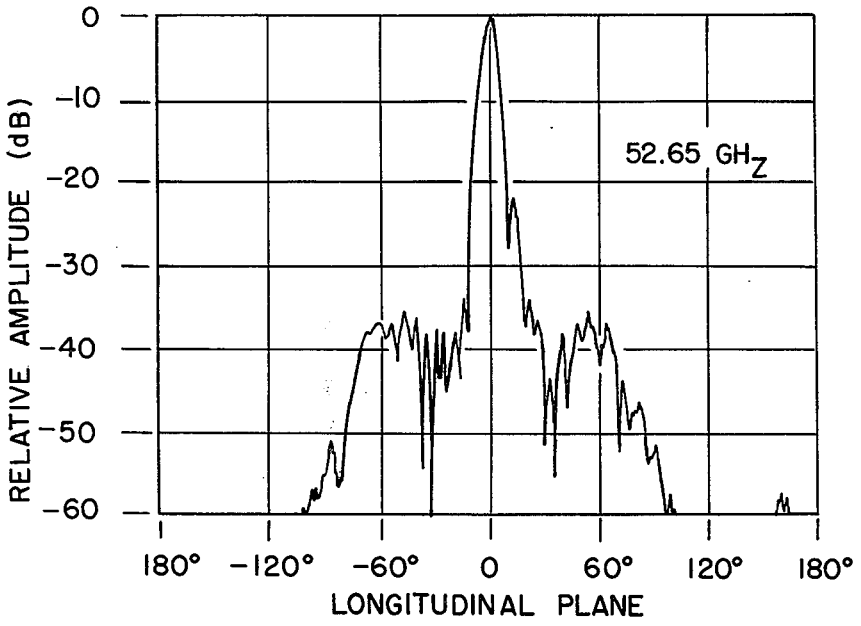
FIGS. 4*a* and 4*b* are typical longitudinal and transverse patterns recorded over a 70dB dynamic range of the antenna system of FIG. 1.
Figure 4B:
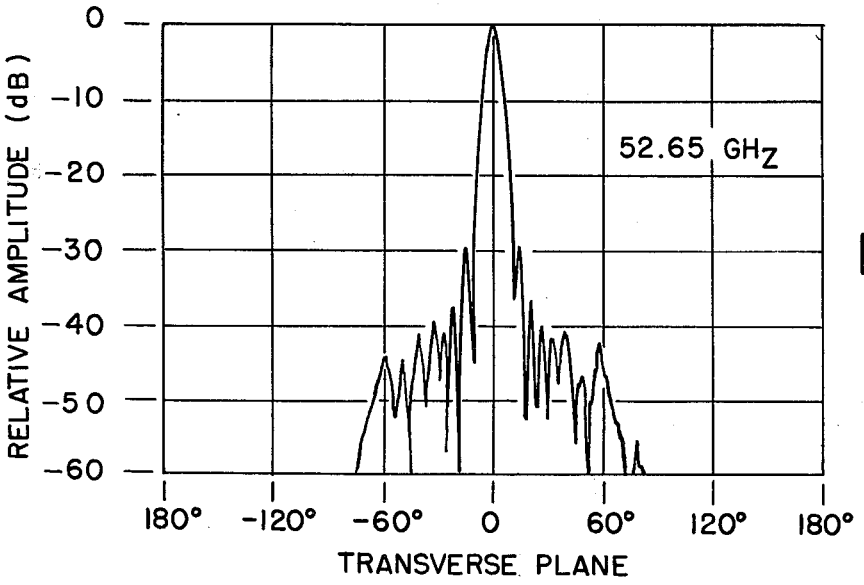
Figure 5:
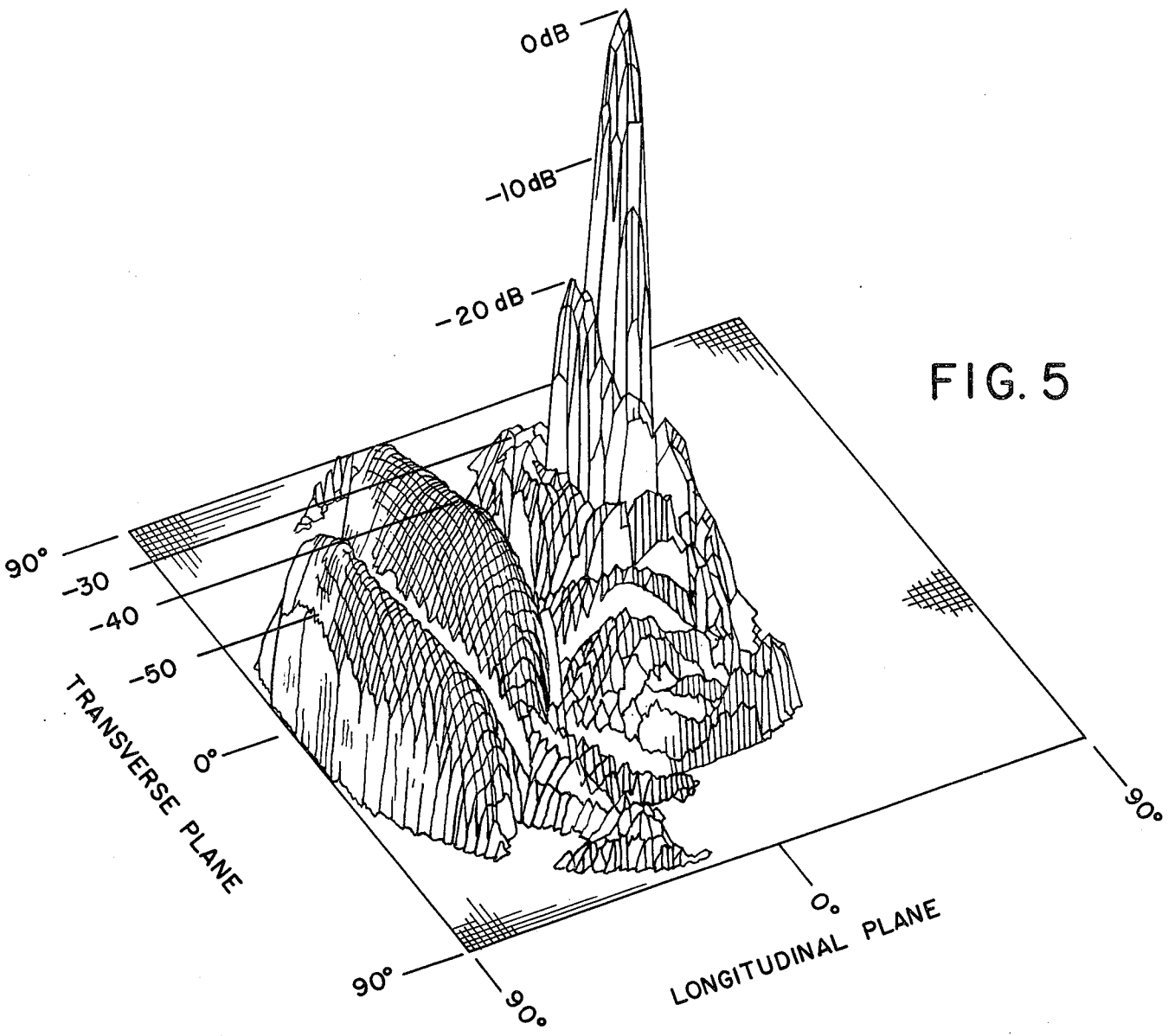
FIG. 5 is a typical amplitude contour projection of the antenna system of FIG. 1.

FIGS. 4*a* and 4*b* are typical 360° longitudinal and transverse patterns recorded over a 70 dB dynamic range on one of the systems. Many off-axis patterns were also recorded and the data was reduced to produce the contour projection of FIG. 5 and calculated beam efficiencies. In all cases, the portion of the total radiated power contained within 10° of the pattern maximum exceeded 95%. Study of FIG. 5 reveals two areas which obviously contain most of the power that is outside the 10° cone half angle:

1. The −20 dB minor lobe
2. The wide lobes at −40 and −50 dB

Numerical results showed the single −20 dB lobe to detract about 1% from beam efficiency. As noted this was caused by the compact design of the illustrated embodiment. The wide lobes at −40 and −50 dB contained about 2% of the total power, and are due to horn spillover past the truncated reflector tip. Again, a larger reflector would improve the result by at least 1%. It therefore is concluded that an optimum hyperbolic reflector fed by a corrugated horn is capable of yielding beam efficiencies over 97%. In this case, spillover will be 1.5% and all diffraction sidelobes from the hyperbolic reflector will be no more than 1.5%. This is several percent better than a lens corrected (linear phase) norms, and is better than any parabolic reflector.

Although particular embodiments of the invention have been described and illustrated herein, it is recognized that modifications and variations may readily occur to those skilled in the art. It is therefore intended that the claims be interpreted to cover such modifications and variations.

What is claimed is:

1. An antenna system for producing a narrow beam of a desired cone angle with a spherical aperture phase front and a far-field beam with low sidelobes and high efficiency, said system comprising a reflector having a concave reflecting surface that is a section of a hyperboloid for reflecting a spherical expanding wave into another spherical expanding wave of an included cone angle equal to said desired cone angle of the desired narrow beam and means for illuminating said reflecting surface with a beam having a circularly symmetric spherical expanding wave of an included angle about twice the cone angle of said desired narrow beam with its phase center at a focus of said hyperbolic reflecting surface, whereby an antenna system is provided with a high beam efficiency greater than 95%.

2. An antenna system as defined in claim 1 including means for supporting said reflector in a spaced position from said illuminating means, and means for rotating said support means about an axis passing through said focus of said hyperboloid reflecting surface, thus scanning the beam reflected by said reflector about said axis.

3. An antenna system as defined in claim 2 wherein said rotating means is capable of rotating said support means continually in either direction through any number of revolutions.

4. An antenna system as defined in claim 1 wherein said illuminating means produces a conical beam.

5. An antenna system as defined in claim 4 wherein said illuminating means is comprised of a corrugated conical horn.

6. An antenna system as defined in claim 5 including a circular waveguide connected to feed said horn.

7. A horn reflector antenna system for producing a spherical aperture phase front wave comprising a corrugated conical horn and a concave reflector that is a section of a hyperboloid having one foci at the phase center of a spherical wave radiated by said conical horn and the other foci at the desired image source of said reflector.

8. An antenna system as defined in claim 7 including means for supporting said reflector from the base of said horn, and means for rotating the support means about the axis of said horn, thus scanning the conical beam reflected by said reflector about the axis of said horn.

9. An antenna system as defined in claim 8 wherein said rotating means is capable of rotating said support means continually in either direction through any number of revolutions.

10. An antenna system as defined in claim 9 including a circular waveguide connected to feed said horn.

* * * * *